US011092988B2

(12) United States Patent
Jin et al.

(10) Patent No.: US 11,092,988 B2
(45) Date of Patent: Aug. 17, 2021

(54) START-UP SPEED ENHANCEMENT CIRCUIT AND METHOD FOR LOWER-POWER REGULATORS

(71) Applicant: INVENSENSE, INC., San Jose, CA (US)

(72) Inventors: Le Jin, Fremont, CA (US); Pradeep Shettigar, San Jose, CA (US); Pablo Moreno Galbis, San Mateo, CA (US)

(73) Assignee: INVENSENSE, INC., San Jose, CA (US)

( * ) Notice: Subject to any disclaimer, the term of this patent is extended or adjusted under 35 U.S.C. 154(b) by 1 day.

(21) Appl. No.: 16/579,210

(22) Filed: Sep. 23, 2019

(65) Prior Publication Data

US 2020/0097033 A1 Mar. 26, 2020

Related U.S. Application Data

(60) Provisional application No. 62/735,884, filed on Sep. 25, 2018.

(51) Int. Cl.
*G05F 1/56* (2006.01)
*G05F 1/46* (2006.01)

(52) U.S. Cl.
CPC ..... *G05F 1/56* (2013.01); *G05F 1/468* (2013.01)

(58) Field of Classification Search
CPC . G05F 1/56; G05F 1/561; G05F 1/461; G05F 1/468
USPC ..... 323/274
See application file for complete search history.

(56) References Cited

U.S. PATENT DOCUMENTS

| | | | | |
|---|---|---|---|---|
| 5,337,284 | A | 8/1994 | Cordoba et al. | |
| 5,384,570 | A * | 1/1995 | Dedic | G11C 27/026 341/155 |
| 8,723,600 | B1 * | 5/2014 | Cagdaser | H03F 3/193 330/259 |
| 8,958,576 | B2 * | 2/2015 | Henriksen | H03F 1/301 381/120 |
| 9,083,288 | B2 * | 7/2015 | Thomsen | H03F 3/68 |
| 9,740,229 | B2 * | 8/2017 | Afzal | G05F 3/30 |
| 2003/0142568 | A1 | 7/2003 | Giove et al. | |
| 2007/0152647 | A1 | 7/2007 | Liao | |
| 2009/0322295 | A1 * | 12/2009 | Scoones | G05F 1/56 323/282 |
| 2013/0021090 | A1 * | 1/2013 | Robertson | G06F 1/26 327/538 |

(Continued)

FOREIGN PATENT DOCUMENTS

WO 2005043733 A1 5/2005

*Primary Examiner* — Yemane Mehari
(74) *Attorney, Agent, or Firm* — Amin, Turocy & Watson, LLP

(57) ABSTRACT

A start-up speed enhancement circuit and method for lower-power regulators is provided herein. Operations of a method can comprise detecting a condition of a power regulator being a start-up condition and applying a first current and a second current to the power regulator based on the start-up condition. The method can also comprise determining the condition of the power regulator changes from the start-up condition to an operation condition. Further, the method can comprise stopping application of the second current to the power regulator based on the condition being the operation condition.

19 Claims, 6 Drawing Sheets

(56) References Cited

U.S. PATENT DOCUMENTS

| | | | | |
|---|---|---|---|---|
| 2013/0021091 | A1* | 1/2013 | Robertson | G06F 1/3203<br>327/540 |
| 2014/0266087 | A1 | 9/2014 | Weng | |
| 2015/0207343 | A1 | 7/2015 | Zhai | |

* cited by examiner

START-UP SPEED ENHANCEMENT CIRCUIT AND METHOD FOR LOWER-POWER REGULATORS

CROSS-REFERENCE TO RELATED APPLICATIONS

This application claims the benefit of U.S. Provisional Application Ser. No. 62/735,884, filed Sep. 25, 2018, and entitled "A START-UP SPEED ENHANCEMENT CIRCUIT FOR LOWER-POWER REGULATORS," the entirety of which is expressly incorporated herein by reference.

TECHNICAL FIELD

This disclosure relates generally to the field of power regulators and, more specifically, to the start-up speed of lower power regulators.

BACKGROUND

Electronic devices are ubiquitous and users of such electronic devices generally demand instant access to usage of such devices. During start-up, the current supplied is the current used for operating the device. Thus, it can take a while for the power circuit to power-up and enter the normal functional mode. Accordingly, users can become frustrated with the wait. Unique challenges exist to provide a shorter power-up mode for electronic devices.

SUMMARY

The subject application relates to start-up speed enhancement circuit for lower-power regulators. According to an embodiment, provided is a circuit that provides an electrical current boost during a start-up phase of a device. The circuit can comprise a first circuit for providing, to the device, a first current at a first amperage level associated with an operational mode of the device. The first circuit can also comprise a second circuit for providing, to the device, a second current at a second amperage level associated with a start-up mode of the device. Further, the circuit can comprise a switch that electrically connects the first circuit and the second circuit to the device during the start-up mode such that both the first current at the first amperage level and the second current at the second amperage level are provided to the device. The switch can also electrically disconnect the second circuit from the device such that a supply of the second current at the second amperage level is discontinued based on the device changing from the start-up mode to the operational mode.

Also provided is a method that can comprise detecting a condition of a power regulator being a start-up condition and applying a first current and a second current to the power regulator based on the start-up condition. The method also can comprise determining the condition of the power regulator changes from the start-up condition to an operation condition. Further, the method can comprise stopping application of the second current to the power regulator based on the condition being the operation condition.

In addition, provided herein is a voltage regulator that can comprise a first node that facilitates receipt of a power down exit mode signal associated with a power regulator. The voltage regulator also can comprise a switch that is operable between an open condition and a closed condition based on a status of the power down exit mode signal. Further, the voltage regulator can comprise a second node that receives a supply of delay current, a capacitor located in a parallel arrangement with the switch, and a Schmitt trigger connected between the second node and the capacitor. In addition, the voltage regulator can comprise a NOR gate comprising a first input connected to the first node and a second input connected to a first output of the Schmitt trigger. Based on a second output of the NOR gate determined to be a bit value of 1, the supply of the delay current and a supply of operation current are provided to the power regulator. Further, based on the second output of the NOR gate determined to be the bit value of 0, the supply of the delay is not supplied to the power regulator and the supply of operation current is provided to the power regulator.

BRIEF DESCRIPTION OF THE DRAWINGS

Various non-limiting embodiments are further described with reference to the accompanying drawings in which.

DETAILED DESCRIPTION

One or more embodiments are now described more fully hereinafter with reference to the accompanying drawings in which example embodiments are shown. In the following description, for purposes of explanation, numerous specific details are set forth in order to provide a thorough understanding of the various embodiments.

In view of longer battery life and a better customer experience, low power consumption is an important specification of a system in the mobile market. Furthermore, systems are put in a power-down or sleep mode when not being used, to further reduce its overall current consumption. When supply current is reduced to the micro amp (uA) level or lower, sometimes it can take a very long time for a circuit to power up from sleep before it can provide expected functionalities. The various aspects provided herein can reduce (sometimes dramatically) the start-up time of systems by supplying extra current during power up, but maintains low current consumption in the normal working state.

Figure 1:
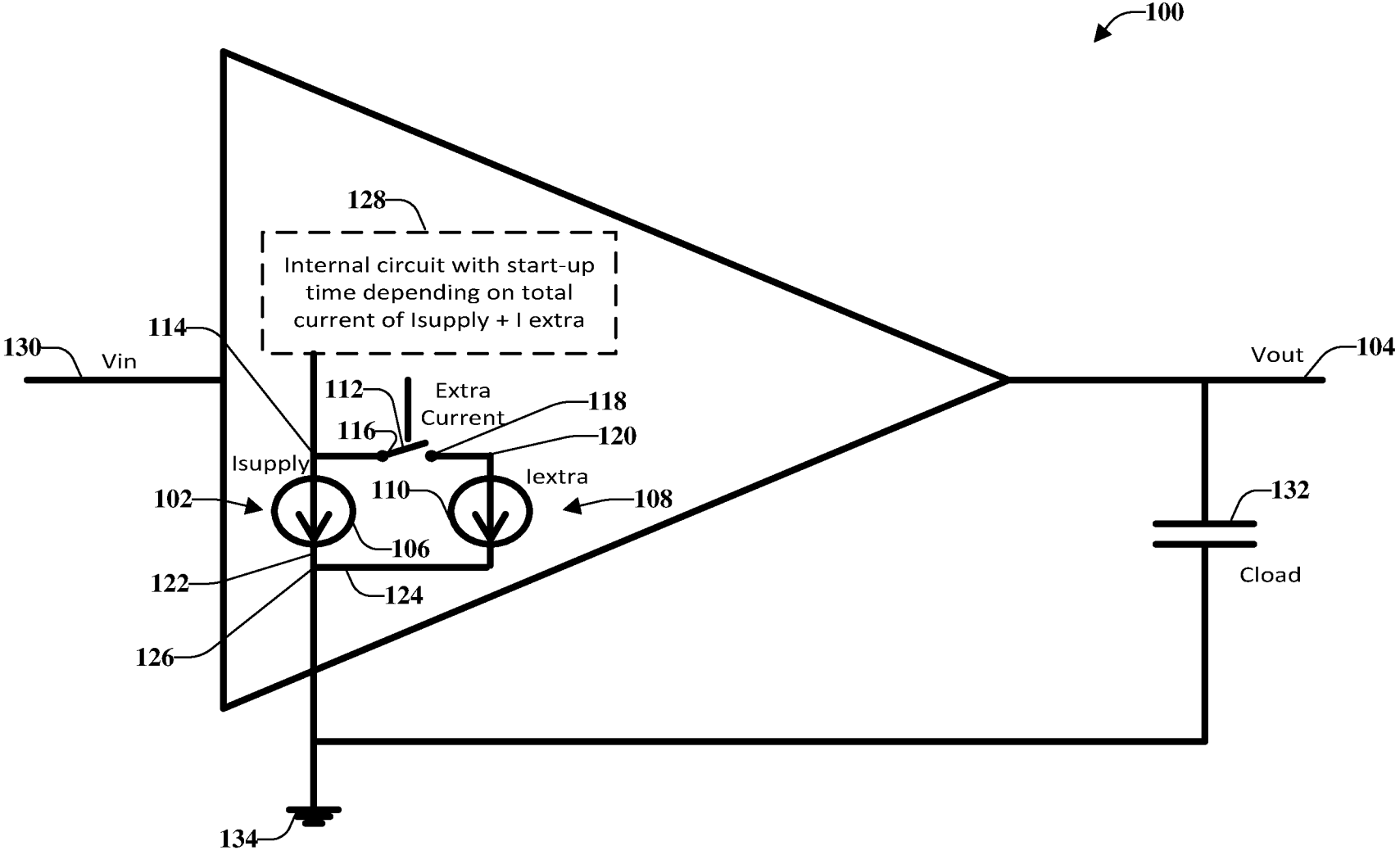
FIG. 1 illustrates an example, non-limiting, schematic representation of a regulator circuit in accordance with one or more embodiments described herein'

With reference initially to FIG. 1, illustrated is an example, non-limiting, schematic representation of a regulator circuit 100 in accordance with one or more embodiments described herein. For low-power voltage regulators, the start-up time could be very long. For example, when a low supply current is used, it can take a significant period of time to charge up internal and external capacitors before the regulator provides the expected voltage output. This long start-up time can limit the speed of the whole system to generate valid data. As discussed herein, extra current is applied to the regulator circuit 100 during a start-up process. Upon or after completion of the start-up process, the extra current is no longer applied and the regulator returns to a lower current consumption state during normal operations.

The regulator circuit 100 can comprise a first circuit 102 for providing, to the device (represented as Vout 104), a first current (e.g., a supply current (Isupply) 106) at a first amperage level associated with an operational mode of the device. Also included in the regulator circuit 100 can be a second circuit 108 for providing, to the device, a second current (e.g., an extra current (Iextra) 110 at a second amperage level associated with a start-up mode of the device.

Also included in the regulator circuit 100 can be a switch 112 that electrically connects the first circuit 102 and the second circuit 108 to the device during the start-up mode such that both the first current (e.g., the supply current (Isupply) 106) at the first amperage level and the second current (e.g., the extra current (Iextra) 110) at the second amperage level are provided to the device. The switch 112 can also electrically disconnect the second circuit 108 (e.g., the extra current (Iextra) 110) from the device such that a supply of the second current at the second amperage level is discontinued based on the device changing from the start-up mode to the operational mode.

In further detail, a first input node 114 of the first circuit 102 can be connected to a first node 116 of the switch 112. A second node 118 of the switch 112 can be connected to a second input node 120 of the second circuit 108. Further, as illustrated, the first circuit 102 and the second circuit 108 can be in a parallel arrangement. In addition, a first output node 122 of the first circuit 102 and a second output node 124 of the second circuit 108 can be operatively connected at 126.

The extra current (Iextra) 110 can be provided via an internal circuit 128, which will be discussed in further detail below with respect to FIG. 2. An input voltage (Vin) 130 is provided to the regulator. In addition, as illustrated a load capacitor (Cload) 132 can be connected between the voltage output (Vout) 104, and at 126, where the first output node 122 of the first circuit 102 and the second output node 124 of the second circuit 108 are operatively connected, and ground 134.

The start-up time of the regulator can be dependent on the total current (e.g., a combination of the supply current (Isupply) 106 and the extra current (Iextra) 110).

Figure 2:
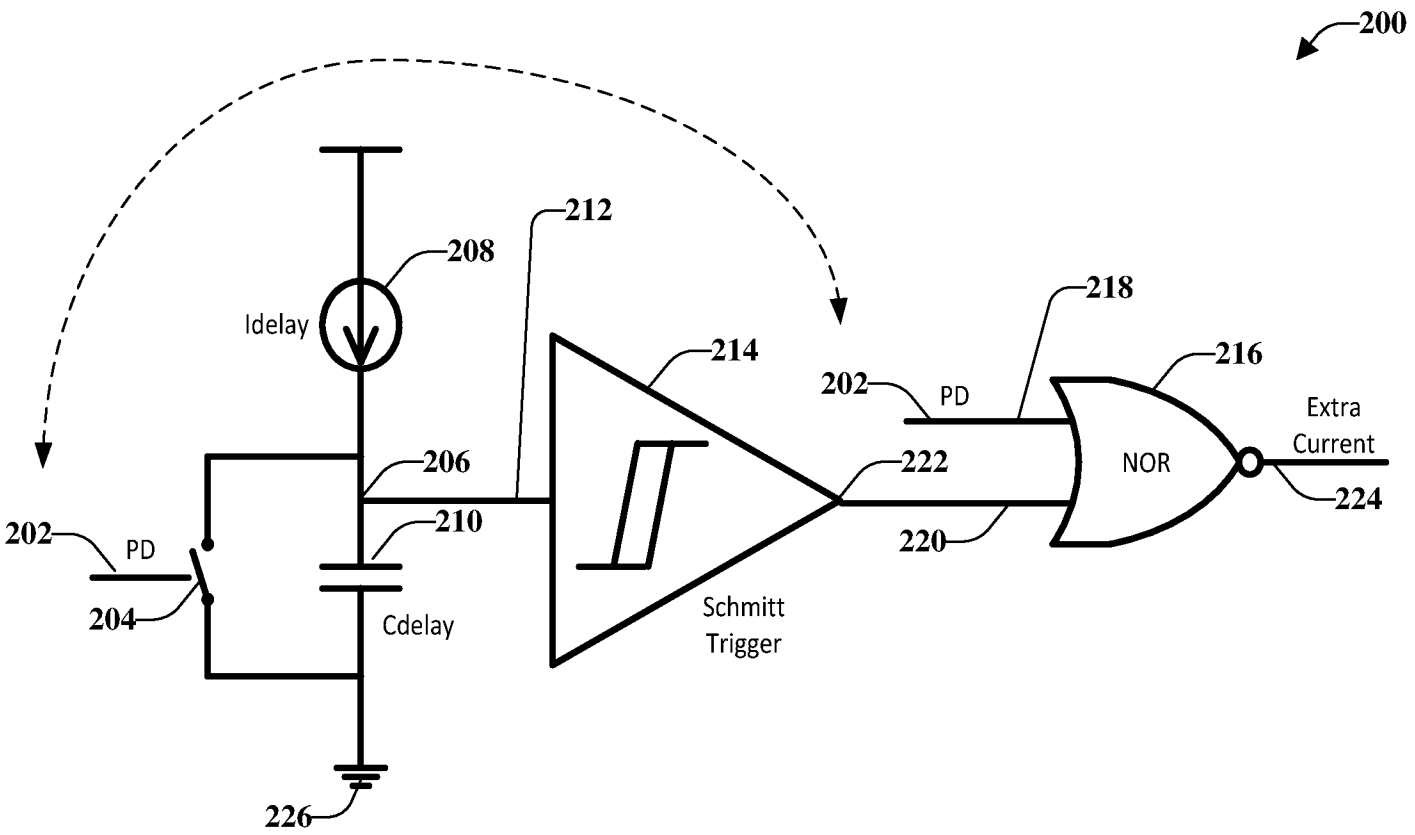
FIG. 2 illustrates an example, non-limiting, schematic representation of an internal circuit of FIG. 1 that is utilized during a power-up mode in accordance with one or more embodiments described herein.

FIG. 2 illustrates an example, non-limiting, schematic representation of the internal circuit 126 of FIG. 1 that is utilized during a power-up mode in accordance with one or more embodiments described herein. Repetitive description of like elements employed in other embodiments described herein is omitted for sake of brevity.

The internal circuit 126 can comprise a first node 202 that facilitates receipt of a power down exit mode signal (PD) associated with a power regulator. Also included is a switch 204 that is operable between an open condition and a closed condition based on a status of the power down exit mode signal.

For example, the switch 204 can be in the open condition (as illustrated) based on the status of the power down exit mode signal being a first status. Further, the switch 204 can be in the closed condition based on the status of the power down exit mode signal being a second status. Further to this example, the first status can be the bit value of 1 based on the power regulator being powered down. Alternatively, the first status can be the bit value of 0 based on the power regulator being powered up.

A second node 206 can receive a supply of delay current (Idelay) 208. Further, a capacitor (Cdelay) 210 can be located in a parallel arrangement with the switch 204. An input node 212 of a Schmitt trigger 214 can be connected between the second node 206 and the capacitor (Cdelay) 210. A Schmitt trigger (e.g., the Schmitt trigger 214) is a comparator circuit. For example, the comparator circuit can have hysteresis implemented by applying positive feedback to a noninverting input positive feedback (e.g., feedback loop) to the noninverting input of a comparator or differential amplifier. The comparator circuit is an active circuit, which can convert an analog input signal to a digital output signal. More specifically, the circuit is named a "trigger" (e.g., a Schmitt trigger) because the output retains its value until the input changes sufficiently to trigger a change.

Further, the internal circuit 126 can comprise a NOR gate 216, which can comprise a first input 218 and a second input 220. The first input 218 can be connected to the first node 202 (e.g., the power down exit mode signal (PD)), denoted by the dashed arrow line. The second input 220 can be connected to an output 222 of the Schmitt trigger 214.

Based on an output 224 of the NOR gate 216 determined to be a bit value of "1", the supply of the delay current 208 and a supply of operation current (e.g., the supply current (Isupply) 102) can be provided to the power regulator as the extra current (e.g., the extra current (Iextra) 108). Alternatively, based on the output 224 of the NOR gate 216 determined to be the bit value of "0", the supply of the delay current 208 is not supplied to the power regulator and the supply of operation current (e.g., the supply current (Isupply) 102) is provided to the power regulator.

For example, based on a voltage of the capacitor increasing to a defined voltage level, the output 222 of the Schmitt trigger 214 can change from the bit value of "0" to the bit value of "1". Further to this example, the output 224 of the NOR gate 216 can change to the bit value of "0".

In some implementations, the power regulator can be a low-power regulator. Further to these implementations, low current consumption can be realized in an operation state based on the output 224 of the NOR gate 216 determined to be the bit value of "0".

As discussed herein, the various aspects can introduce extra current during start-up in order to bring the regulator to the normal operation state faster. The extra current can be turned off when the regulator is in normal operation to save power.

To provide further details, when the PD signal is high (e.g., is "1"), the circuit is powered down. Thus, the circuit starts (e.g., is activated or turned-on) when the PD signal goes from high to low (e.g., from "1" to "0"). When the PD signal is "1," the switch is closed. Therefore, the voltage across the delay capacitor (Cdelay) 210 is going to ground 226 (e.g., discharges because the voltage across the delay capacitor (Cdelay) 210 is zero (e.g., it is shorted out)). The output 222 of the Schmitt trigger 214 is zero and the output 224 of the NOR gate 216 is zero.

When the PD goes from "1" to "0", the circuit is powered up, the output 222 of the Schmitt trigger 214 is "0."

Therefore, the output 224 of the NOR gate 216 becomes "1," since the inputs (e.g., the first input 218 and the second input 220) to the NOR gate 216 are both "0," and the power is sped up (e.g., additional current is provided as discussed herein). Further, when the PD goes from "1" to "0", the switch 204 is open. The delay current (Idelay) 208 starts charging the delay capacitor (Cdelay) 210 and brings the input node 212 of the Schmitt trigger 214 higher. After a period of time, the output 222 of the Schmitt trigger 214 also becomes "1." When the output 222 of the Schmitt trigger 214 becomes "1," the output 224 of the NOR gate 216 (e.g., the extra current control bit) becomes "0" again and the extra current (e.g., the delay current (Idelay) 208) stops. Then, the circuit is brought to the normal operation mode and only the supply current (e.g., the supply current (Isupply) 106) is used.

Methods that can be implemented in accordance with the disclosed subject matter, will be better appreciated with reference to various flow charts. While, for purposes of simplicity of explanation, the methods are shown and described as a series of blocks, it is to be understood and appreciated that the disclosed aspects are not limited by the number or order of blocks, as some blocks can occur in different orders and/or at substantially the same time with other blocks from what is depicted and described herein. Moreover, not all illustrated blocks can be required to implement the disclosed methods. It is to be appreciated that the functionality associated with the blocks can be implemented by software, hardware, a combination thereof, or any other suitable means (e.g., device, system, process, component, and so forth). Additionally, it should be further appreciated that the disclosed methods are capable of being stored on an article of manufacture to facilitate transporting and transferring such methods to various devices. Those skilled in the art will understand and appreciate that the methods could alternatively be represented as a series of interrelated states or events, such as in a state diagram.

Figure 3:
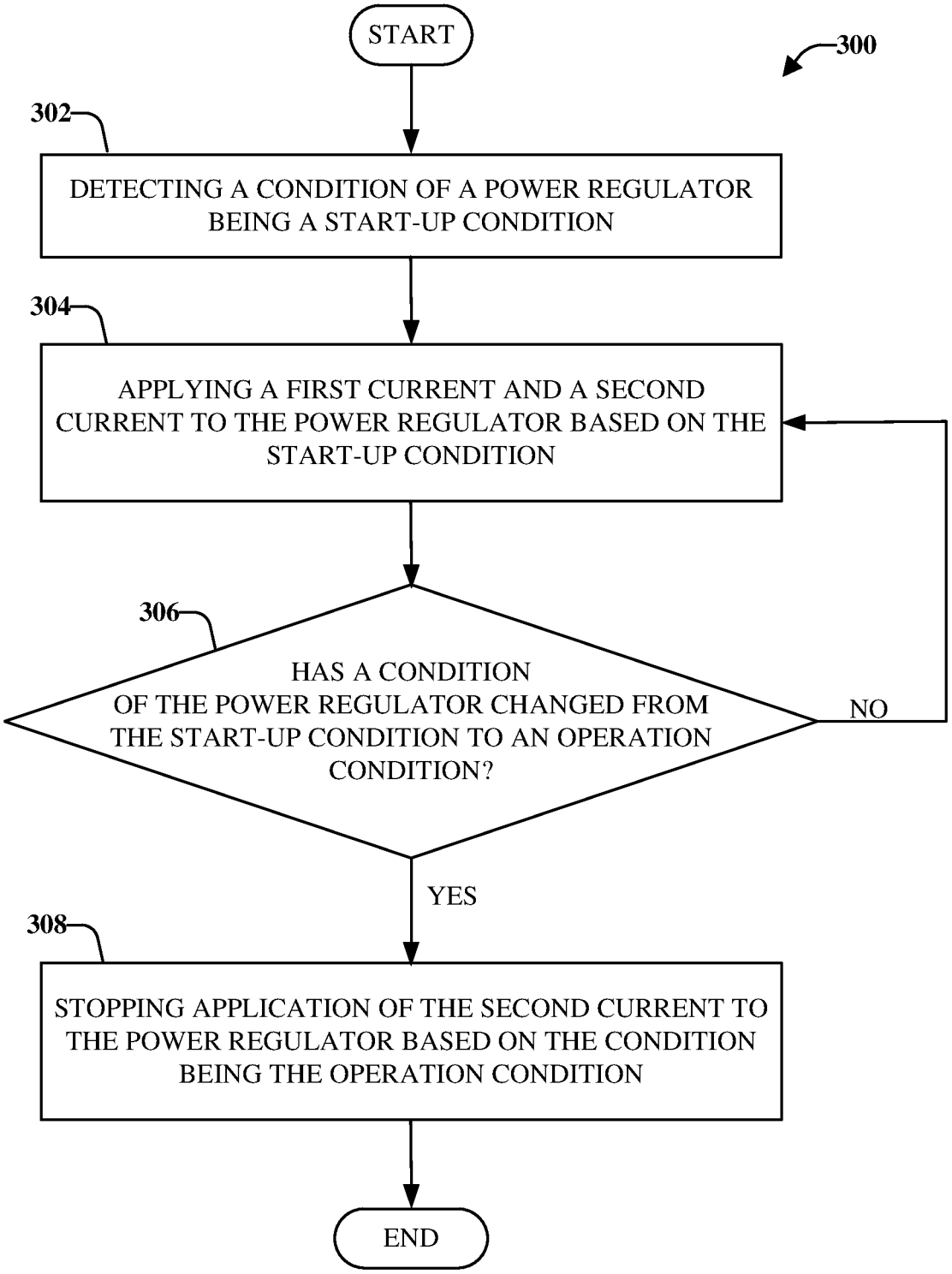
FIG. 3 illustrates a flow diagram of an example, non-limiting, method for facilitating a supply of additional current during a power-up mode of a device in accordance with one or more embodiments described herein.

FIG. 3 illustrates a flow diagram of an example, non-limiting, method 300 for facilitating a supply of additional current during a power-up mode of a device in accordance with one or more embodiments described herein. Repetitive description of like elements employed in other embodiments described herein is omitted for sake of brevity.

In normal operation mode, the supply current (e.g., the supply current (Isupply) 106) can be a low value (e.g., a microamp or less (e.g., hundreds of milliamps)). If only the Isupply is used to power up the circuit, it will take very long (e.g., tens of micro seconds or more) for the Vout (e.g., the Vout 104) to reach the desired level. To address this and related ends, as discussed herein, during a power up mode, extra current (e.g., the extra current (Iextra) 110) is brought through the switch (e.g., the switch 112). On top of Isupply there is Iextra and the two currents together will bring Vout to the normal operation mode much faster (e.g., maybe below 10 microseconds). After Vout reaches the desired level, Iextra is turned off and only Isupply is used to maintain the desired level of Vout of the regulator.

Thus, when Vout reaches the correct level, the switch (e.g., the switch 112) for the Iextra opens and only the Isupply is used. Therefore, the overall current consumption in the normal operation mode will be low. According to some implementations, he Isupply current value can be the same as the Iextra current value, a little more, or a lot more. For example, if the Isupply is half a microamp, the Iextra could be two microamps or four microamps. However, different values of Isupply and Iextra could be used and can be a function of design choice and/or a speed at which the device should be powered up.

At 302 of the method 300, a condition of a power regulator can be detected and determined to be a start-up condition. Based upon the start-up condition being detected, at 304, a first current (e.g., the supply current (Isupply) 102) and a second current (e.g. the extra current (Iextra) 108) can be applied to the power regulator. According to some implementations, applying the second current to the power regulator can comprise enabling an electrical connection between a source of the second current and the power regulator. In accordance with some implementations, applying the second current to the power regulator can comprise determining a status of a power down exit mode signal control bit has changed from a first status to a second status. For example, the first status can be "0" and the second status can be "1."

A determination can be made, at 306 of the method 300, whether the condition of the power regulator changes from the start-up condition to an operation condition. If the determination is that the condition of the power regulator has not changed ("NO"), the method 300 continues at 304 with continuing application of the first current and the second current.

However, if the determination at 306 is that the condition of the power regulator has changed from the start-up condition to an operation condition ("YES"), at 308, application of the second current to the power regulator can be stopped. In accordance with some implementations, stopping the application of the second current can comprise disabling a connection between a source of the second current and the power regulator. The first current continues to be applied to the power regulator during the operation condition. Additionally, stopping the application of the second current can comprise conserving power consumption of the power regulator.

Figure 4:
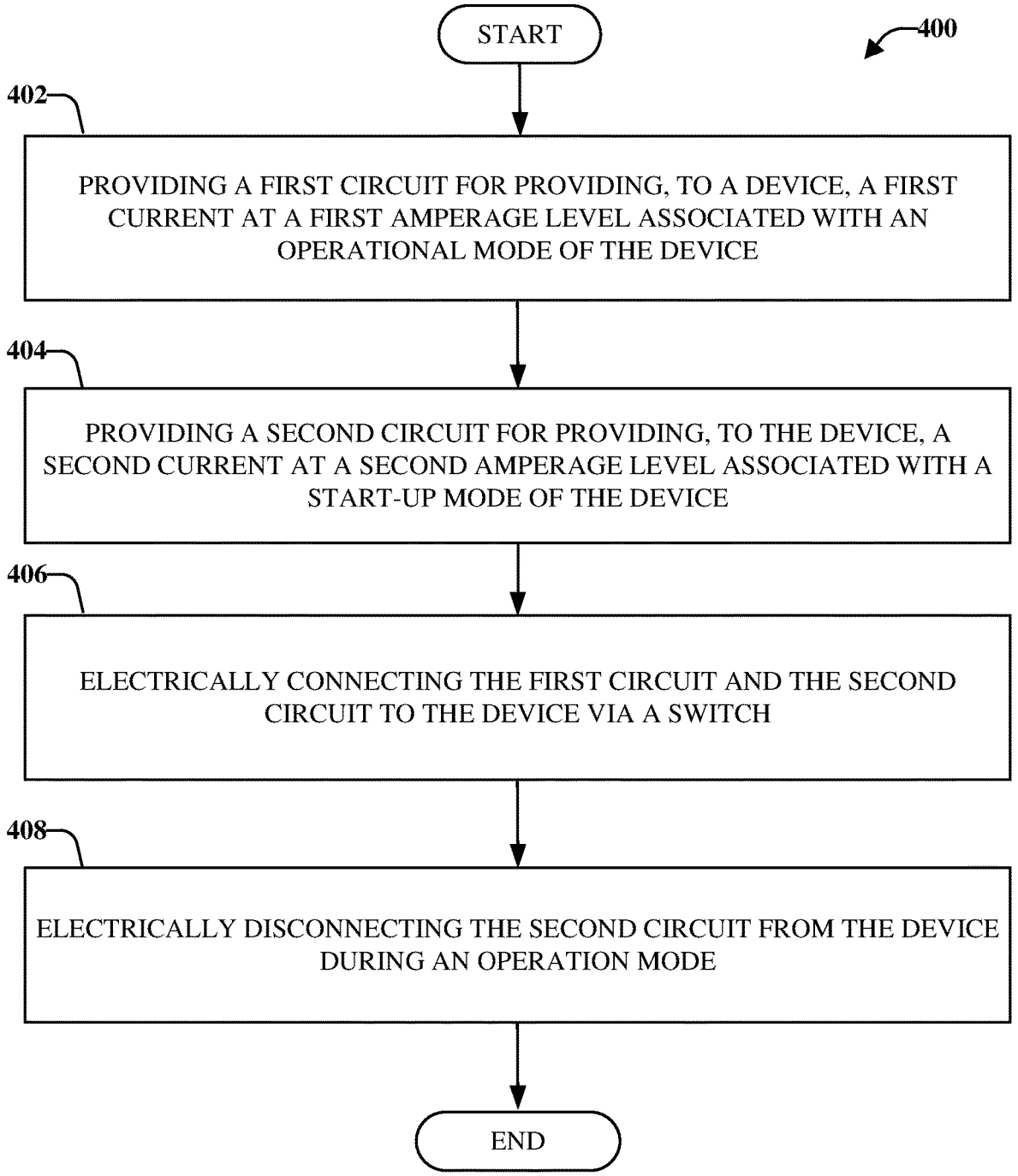
FIG. 4 illustrates a flow diagram of an example, non-limiting, method for providing a circuit that provides an electrical current boost during a start-up phase of a device in accordance with one or more embodiments described herein.

FIG. 4 illustrates a flow diagram of an example, non-limiting, method 400 for providing a circuit that provides an electrical current boost during a start-up phase of a device in accordance with one or more embodiments described herein. Repetitive description of like elements employed in other embodiments described herein is omitted for sake of brevity.

The method 400 starts, at 402, when a first circuit (e.g., the first circuit 102) for providing, to a device (e.g., represented by Vout 104), a first current (e.g., the supply current (Isupply) 102) at a first amperage level associated with an operational mode of the device can be provided. Further, at 404, a second circuit (e.g., the second circuit 108) for providing, to the device, a second current (e.g., the extra current (Iextra 110) at a second amperage level associated with a start-up mode of the device can be provided.

According to some implementations, the first amperage level and the second amperage level can be a same amperage level. In some implementations, the first amperage level can comprise a first value and the second amperage level can comprise a second value that is larger than the first value.

At 406, the first circuit and the second circuit are electrically connected to the device via a switch (e.g., the switch 112). The first circuit and second circuit are both electrically connected to the device during the start-up mode such that both the first current at the first amperage level and the second current at the second amperage level are provided to the device.

Further, at 408, the second circuit is electrically disconnected from the device during an operation mode. The second circuit is electrically disconnected from the device such that a supply of the second current at the second amperage level is discontinued based on the device changing from the start-up mode to the operational mode. For example, the second circuit can be bypassed during the operational mode of the device. By disconnecting the second circuit (or bypassing the second circuit), power of the device can be conserved based on the supply of the second current no longer being provided to the device.

A start-up time of the device can be determined based on a combined value of the first amperage level and the second amperage level. According to some implementations, the start-up time of the device can be shorter as compared to usage of the first circuit without the second circuit during the start-up mode of the device.

According to some implementations, a first input node of the first circuit is connected to a first node of the switch and a second node of the switch is connected to a second input node of the second circuit. Further, the first circuit and the second circuit can be in a parallel arrangement. A first output node of the first circuit and a second output node of the second circuit can be operative connected. According to some implementations, the switch is closed during the start-up mode of the device. Further to these implementations, the switch is open during the operational mode of the device.

Figure 5:
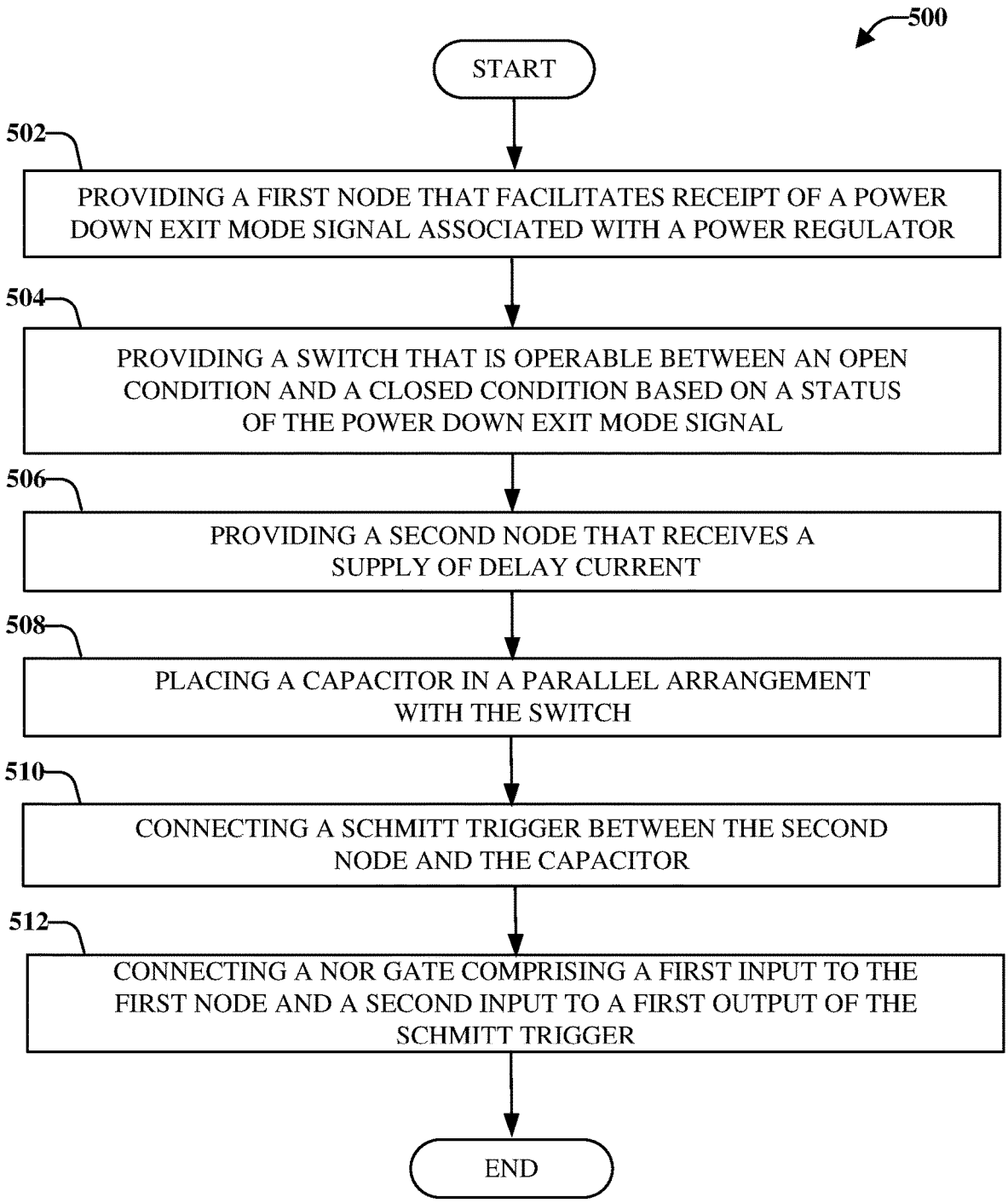
FIG. 5 illustrates a flow diagram of an example, non-limiting, method for providing a voltage regulator that facilitates application of an electrical current boost during a start-up phase of a device in accordance with one or more embodiments described herein.

FIG. 5 illustrates a flow diagram of an example, non-limiting, method 500 for providing a voltage regulator that facilitates application of an electrical current boost during a start-up phase of a device in accordance with one or more embodiments described herein. Repetitive description of like elements employed in other embodiments described herein is omitted for sake of brevity.

At 502, a first node (e.g., the first node 202) that facilitates receipt of a power down exit mode signal associated with a power regulator is provided. Also provided, at 504, is a switch (e.g., the switch 204) that is operable between an open condition and a closed condition based on a status of the power down exit mode signal.

According to some implementations, the switch can be in the open condition based on the status of the power down exit mode signal being a first status. Further to these implementations, the switch can be in the closed condition based on the status of the power down exit mode signal being a second status. In an example, the first status can be the bit value of "1" based on the power regulator being powered down. Further to this example, the first status can be the bit value of "0" based on the power regulator being powered up. It is noted that the disclosed aspects are not limited to this implementation and, instead, the value of "1" can represent the power regulator being powered up and the value of "0" can represent the power regulator being powered down.

At 506, a second node (e.g., the second node 206) that receives a supply of delay current (e.g., the delay current (Idelay) 208) is provided. A capacitor (e.g., the delay capacitor (Cdelay) 210) can be placed in a parallel arrangement with the switch, at 508. A Schmitt trigger (e.g., the Schmitt trigger 214) can be connected between the second node and the capacitor, at 510. Further, at 512, a NOR gate (e.g., the NOR gate 216) comprising a first input (e.g., the first input 218) can be connected to the first node and a second input (e.g., the second input 220) can be connected to a first output (e.g., the output 222) of the Schmitt trigger.

According to some implementations, based on a second output of the NOR gate determined to be a bit value of "1," the supply of the delay current and a supply of operation current are provided to the power regulator. Further to these implementations, based on the second output of the NOR gate determined to be the bit value of "0," the supply of the delay current is not supplied to the power regulator and only the supply of operation current is provided to the power regulator.

In an example, based on a voltage of the capacitor increasing to a defined voltage level, the first output of the Schmitt trigger can change from the bit value of "0" to the bit value of "1" and the second output of the NOR gate can change to the bit value of "0."

According to some implementations, the power regulator can be a low-power regulator. Further, to these implementations, low current consumption is realized in an operation state based on the second output of the NOR gate determined to be the bit value of "0."

Figure 6:
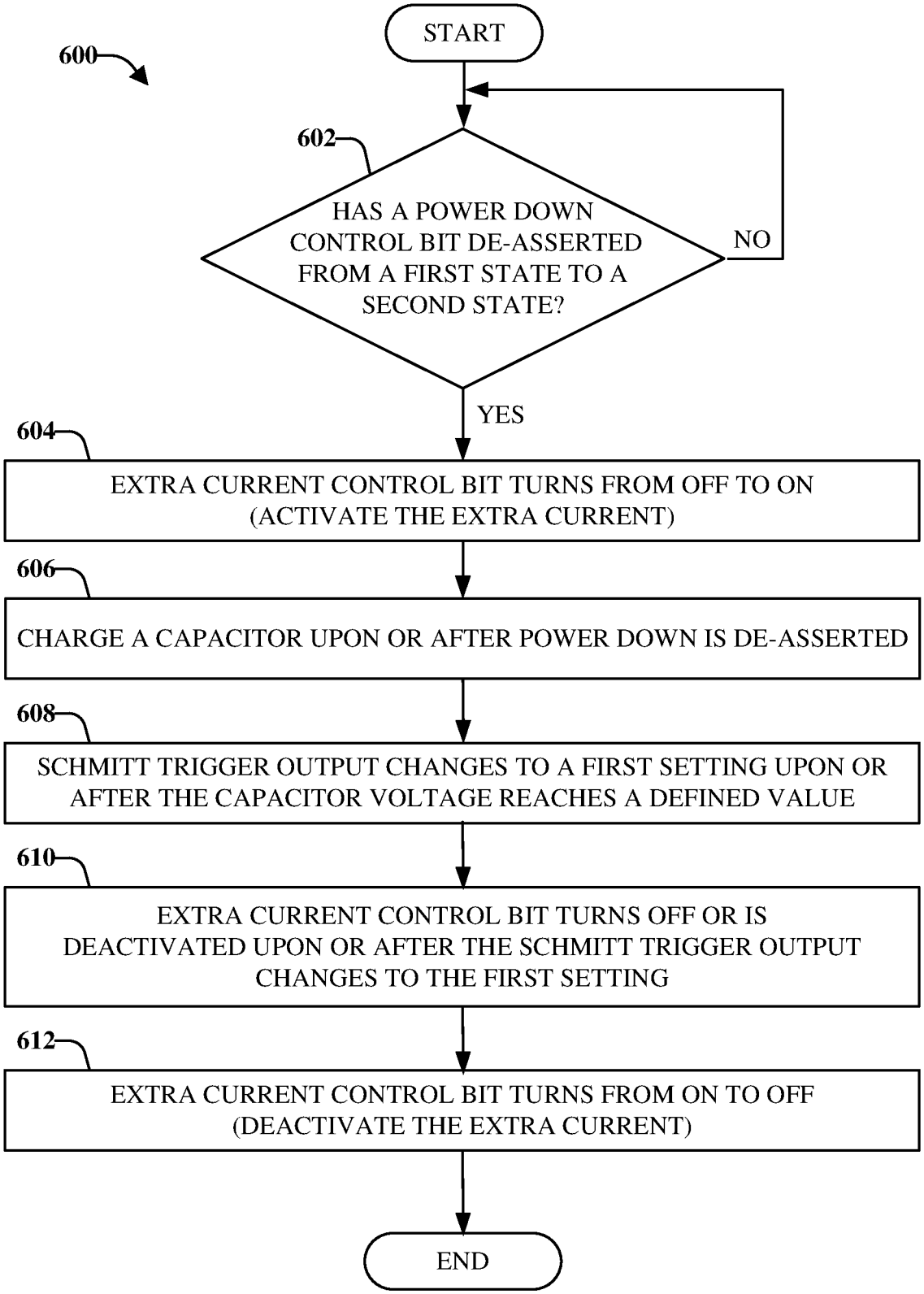
FIG. 6 illustrates a flow diagram of an example, non-limiting, method for providing extra current during start-up and removing the extra current upon or after entry into a normal operation in accordance with one or more embodiments described herein.

FIG. 6 illustrates a flow diagram of an example, non-limiting, method 600 for providing extra current during start-up and removing the extra current upon or after entry into a normal operation in accordance with one or more embodiments described herein. Repetitive description of like elements employed in other embodiments described herein is omitted for sake of brevity.

At 602, a determination is made whether a PD control bit is de-asserted from a first state to a second state. According to some implementations, the first state can be "1" and the second state can be "0." If the PD control bit has not de-asserted from the first state to the second state ("NO"), the method 600 can wait until the de-assertion happens.

Upon or after the determination at 602 is that the PD control bit has de-asserted from the first state to the second state ("YES"), at 604, an extra current control bit turns on or is activated (e.g., from off to on, from "0" to "1"). Turning on the extra current can inject more current in the regulator for faster start up. Further, at 606, a capacitor can be charged upon or after the PD is de-asserted.

The Schmitt trigger output can change to a first setting (e.g., "1"), at 608, upon or after the capacitor voltage reaches a defined value. For example, the defined value can be a value determined to be a value associated with an operation mode. In addition, at 610, the extra current control bit turns off or is deactivated (e.g., from on to off, from "1" to "0") upon or after the Schmitt trigger output changes to the first setting. Thus, the extra current control bit is changed from on to off (e.g., deactivate the extra current), at 612. Accordingly, extra power can be supplied during a power-on mode and, upon reaching an operating mode, the extra power can be discontinued.

Reference throughout this specification to "one embodiment," or "an embodiment," means that a particular feature, structure, or characteristic described in connection with the embodiment is included in at least one embodiment. Thus, the appearances of the phrase "in one embodiment," "in one aspect," or "in an embodiment," in various places throughout this specification are not necessarily all referring to the same embodiment. Furthermore, the particular features, structures, or characteristics can be combined in any suitable manner in one or more embodiments.

In addition, the words "example" and "exemplary" are used herein to mean serving as an instance or illustration. Any embodiment or design described herein as "example" or "exemplary" is not necessarily to be construed as preferred or advantageous over other embodiments or designs. Rather, use of the word example or exemplary is intended to present concepts in a concrete fashion. As used in this application, the term "or" is intended to mean an inclusive "or" rather than an exclusive "or." That is, unless specified otherwise or clear from context, "X employs A or B" is intended to mean any of the natural inclusive permutations.

That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

As used herein, the term "infer" or "inference" refers generally to the process of reasoning about, or inferring states of, the system, environment, user, and/or intent from a set of observations as captured via events and/or data. Captured data and events can include user data, device data, environment data, data from sensors, sensor data, application data, implicit data, explicit data, etc. Inference can be employed to identify a specific context or action, or can generate a probability distribution over states of interest based on a consideration of data and events, for example.

Inference can also refer to techniques employed for composing higher-level events from a set of events and/or data. Such inference results in the construction of new events or actions from a set of observed events and/or stored event data, whether the events are correlated in close temporal proximity, and whether the events and data come from one or several event and data sources. Various classification procedures and/or systems (e.g., support vector machines, neural networks, expert systems, Bayesian belief networks, fuzzy logic, and data fusion engines) can be employed in connection with performing automatic and/or inferred action in connection with the disclosed subject matter.

In addition, the various embodiments can be implemented as a method, apparatus, or article of manufacture using standard programming and/or engineering techniques to produce software, firmware, hardware, or any combination thereof to control a computer to implement the disclosed subject matter. The term "article of manufacture" as used herein is intended to encompass a computer program accessible from any computer-readable device, machine-readable device, computer-readable carrier, computer-readable media, machine-readable media, computer-readable (or machine-readable) storage/communication media. For example, computer-readable media can comprise, but are not limited to, a magnetic storage device, e.g., hard disk; floppy disk; magnetic strip(s); an optical disk (e.g., compact disk (CD), a digital video disc (DVD), a Blu-ray Disc™ (BD)); a smart card; a flash memory device (e.g., card, stick, key drive); and/or a virtual device that emulates a storage device and/or any of the above computer-readable media. Of course, those skilled in the art will recognize many modifications can be made to this configuration without departing from the scope or spirit of the various embodiments The above description of illustrated embodiments of the subject disclosure, including what is described in the Abstract, is not intended to be exhaustive or to limit the disclosed embodiments to the precise forms disclosed. While specific embodiments and examples are described herein for illustrative purposes, various modifications are possible that are considered within the scope of such embodiments and examples, as those skilled in the relevant art can recognize.

In this regard, while the subject matter has been described herein in connection with various embodiments and corresponding figures, where applicable, it is to be understood that other similar embodiments can be used or modifications and additions can be made to the described embodiments for performing the same, similar, alternative, or substitute function of the disclosed subject matter without deviating therefrom. Therefore, the disclosed subject matter should not be limited to any single embodiment described herein, but rather should be construed in breadth and scope in accordance with the appended claims below.

What is claimed is:

1. A circuit that provides an electrical current boost during a start-up phase of a device, comprising:

a first circuit for providing, to the device, a first current at a first amperage level associated with an operational mode of the device;

a second circuit for providing, to the device, a second current at a second amperage level associated with a start-up mode of the device; and a switch that electrically connects the first circuit and the second circuit to the device during the start-up mode such that both the first current at the first amperage level and the second current at the second amperage level are provided to the device, and electrically disconnects the second circuit from the device such that a supply of the second current at the second amperage level is discontinued based on the device changing from the start-up mode to the operational mode, wherein a first input node of the first circuit is connected to a first node of the switch and a second node of the switch is connected to a second input node of the second circuit, wherein the first circuit and the second circuit are in a parallel arrangement, and wherein a first output node of the first circuit and a second output node of the second circuit are operatively connected.

2. The circuit of claim 1, wherein the second circuit is bypassed during the operational mode of the device.

3. The circuit of claim 1, wherein a start-up time of the device is determined based on a combined value of the first amperage level and the second amperage level.

4. The circuit of claim 1, wherein a start-up time of the device is shorter as compared to usage of the first circuit without the second circuit during the start-up mode of the device.

5. The circuit of claim 1, wherein the switch is closed during the start-up mode of the device, and wherein the switch is open during the operational mode of the device.

6. The circuit of claim 1, wherein power of the device is conserved based on the supply of the second current being discontinued.

7. The circuit of claim 1, wherein the first amperage level and the second amperage level are a same amperage level.

8. The circuit of claim 1, wherein the first amperage level comprises a first value and the second amperage level comprises a second value that is larger than the first value.

9. A method, comprising:

detecting a condition of a power regulator being a start-up condition;

applying a first current and a second current to the power regulator based on the start-up condition;

determining the condition of the power regulator changes from the start-up condition to an operation condition; and stopping application of the second current to the power regulator based on the condition being the operation condition, wherein the applying comprises applying the first current via a first circuit and applying the second current via a second circuit, wherein a first input node of the first circuit is connected to a first node of a switch and a second node of the switch is connected to a second input node of the second circuit, wherein the first circuit and the second circuit are in a parallel arrangement, and wherein a first output node of the first circuit and a second output node of the second circuit are operatively connected.

10. The method of claim 9, wherein the applying the second current to the power regulator comprises enabling an electrical connection between a source of the second current and the power regulator.

11. The method of claim 9, wherein the stopping the application of the second current comprises disabling a connection between a source of the second current and the power regulator, wherein the first current continues to be applied to the power regulator during the operation condition.

12. The method of claim 9, wherein the stopping the application of the second current comprises conserving power consumption of the power regulator.

13. The method of claim 9, wherein the applying the second current to the power regulator comprises determining a status of a power down exit mode signal control bit has changed from a first status to a second status.

14. The method of claim 13, wherein the first status is "0" and the second status is "1".

15. A voltage regulator, comprising:

a first node that facilitates receipt of a power down exit mode signal associated with a power regulator;

a switch that is operable between an open condition and a closed condition based on a status of the power down exit mode signal;

a second node that receives a supply of delay current;

a capacitor located in a parallel arrangement with the switch;

a Schmitt trigger connected between the second node and the capacitor; and a NOR gate comprising a first input connected to the first node and a second input connected to a first output of the Schmitt trigger, wherein based on a second output of the NOR gate determined to be a bit value of 1, the supply of the delay current and a supply of operation current are provided to the power regulator, and wherein based on the second output of the NOR gate determined to be the bit value of 0, the supply of the delay current is not supplied to the power regulator and the supply of operation current is provided to the power regulator.

16. The voltage regulator of claim 15, wherein the switch is in the open condition based on the status of the power down exit mode signal being a first status, and wherein the switch is in the closed condition based on the status of the power down exit mode signal being a second status.

17. The voltage regulator of claim 16, wherein the first status is the bit value of 1 based on the power regulator being powered down, and wherein the first status is the bit value of 0 based on the power regulator being powered up.

18. The voltage regulator of claim 15, wherein based on a voltage of the capacitor increasing to a defined voltage level, the first output of the Schmitt trigger changes from the bit value of 0 to the bit value of 1 and the second output of the NOR gate changes to the bit value of 0.

19. The voltage regulator of claim 15, wherein the power regulator is a low-power regulator, and wherein low current consumption is realized in an operation state based on the second output of the NOR gate determined to be the bit value of 0.

* * * * *